US006203626B1

(12) United States Patent
Biggs et al.

(10) Patent No.: US 6,203,626 B1
(45) Date of Patent: Mar. 20, 2001

(54) ERGONOMIC MOP METHOD

(76) Inventors: Blyth S. Biggs; Brenden Biggs, both of 18 Brown Dr. Unit #1, Carson City, NV (US) 89706

( * ) Notice: Subject to any disclaimer, the term of this patent is extended or adjusted under 35 U.S.C. 154(b) by 0 days.

(21) Appl. No.: 09/290,360

(22) Filed: Apr. 12, 1999

Related U.S. Application Data

(63) Continuation-in-part of application No. 09/073,016, filed on Jun. 4, 1998, now Pat. No. 5,920,944.

(51) Int. Cl.[7] ..... B08B 7/00
(52) U.S. Cl. ..... 134/6; 134/42
(58) Field of Search ..... 134/6, 7; 15/143.1, 15/144.1, 144.2, 144.3, 144.4, 145, 228, 229.1, 229.2, 229.3, 229.4, 229.5, 229.6, 229.7, 229.8, 229.9; 16/110 R, 111 R, 115; D32/50, 51, 52

(56) References Cited

U.S. PATENT DOCUMENTS

| | | | | |
|---|---|---|---|---|
| D. 359,605 | * | 6/1995 | Janikowski | D32/51 |
| 2,536,607 | * | 1/1951 | Jenkins | 56/400.17 |
| 5,133,101 | * | 7/1992 | Hauser et al. | 15/143.1 |
| 5,319,824 | * | 6/1994 | Cook, III | 15/160 |
| 5,581,839 | * | 12/1996 | Ferrell, Jr. | 15/143.1 |
| 5,606,772 | * | 3/1997 | Ilic | 15/114 R |

* cited by examiner

*Primary Examiner*—Randy Gulakowski
*Assistant Examiner*—Saeed Chaudhry
(74) *Attorney, Agent, or Firm*—Herbert C. Schulze

(57) ABSTRACT

A method of mopping including the use of unique mop handle means which allows an offset gripping of the handle intermediate its ends and utilization of rotatable swivel grip on one end, which enables the user of a mop to mop more efficiently and with reduced risk of injury including repetitive motion injuries and the like.

2 Claims, 3 Drawing Sheets

ERGONOMIC MOP METHOD

CROSS REFERENCE TO RELATED PATENT APPLICATIONS

This invention is related to our application for patent for Ergonomic Mop Method and Apparatus, Ser. No. 09/073,016, filed Jun. 4,1998, now U.S. Pat. No. 5,920,944, and is a continuation in part thereof.

BACKGROUND OF THE INVENTION

I. Field of the Invention

This invention is in the general field of a mop for mopping floors, decks, and the like;

This invention is more particularly in the field of such a mop designed to relieve excess stress and fatigue for the user of the mops;

This invention is even more particularly in the field of such a mop designed to relieve stress and fatigue and the danger of injury to the user;

This invention is most particularly in the fields above mentioned and in the field of a mop handle designed to accomplish all of this and a method for mopping to allow for a much larger work space from one position for the user than is customary and at the same time relieving fatigue and stress normally experienced in mopping.

II. Description of the Prior Art

Mops have been known for centuries. All mops share the common characteristic that they consist of an elongated rod for a handle with mopping material consisting of a bundle of strands of yarn, absorbent string, sponge, or the like on one end of the rod, the length of the rod generally being a few feet, terminating in a plain end on the rod. All mops known to us are of the above configuration.

The mop and method of mopping of this invention is completely different from the prior art. Our invention includes special mops with a longer than normal handle being provided with unique angularly offset portions and terminating in a unique swivel hand grip on the end not carrying the mopping material and attachments for standard mop handles which allow the practice of or unique method of mopping.

In the sense described above, we believe there is no true prior art to our invention described in this specification.

SUMMARY OF THE INVENTION

A mop is one of the most widely used of all implements. Going into a super market, one will see a clerk mopping a spill; Going onto a deck, one will see a mop being used; Staying in a hotel, one will see a mop; In the average home, one will see a mop; Mops literally pervade every aspect of civilized (and even uncivilized) life.

However, the life of one wielding a mop is not easy. Users of mops suffer from many discomforts and disabilities. The customary mop is a very troublesome implement. Many serious, and continuing, injuries and discomforts result from the use of mops.

Additionally, mopping is a very inefficient process due to the restrictive nature of the mop.

We have been engaged in mopping and have studied mopping seeking relief from the problems associated with mopping and attempting to perfect a more desirable mopping procedure.

We have now developed a superior, unusual, and unique mop and mopping technique.

We have conceived and developed a mop (primarily the mop handle) which solves all of the problems associated with mopping, and which no one has conceived before.

We have designed a mop incorporating an unusual and unique design, together with a special swivel top handle arrangement which eliminates the former problems with mops and produces a superior mop capable of producing more mopping results with less effort and no injuries or fatigue.

We have done this by making a special offset handle design with a unique top swivel handle support member. Additionally, we have now conceived and developed a unique further method for mopping which includes utilization of attachments for mop handles to allow mopping in a manner which reduces strain and increases effective mopping area from a single position of the person using the mop.

We have, also, developed a method of mopping in which one engaged in mopping may use a special attachment to a standard mop handle, as well as our special handle, to greatly increase the effectiveness of the mopping as well as reducing the stress, strain, and fatigue normally experienced in mopping.

It is an object of this invention to provide a mop which will extend the effective mopping area from any given position;

Another object of this invention is to provide a mop which will diminish fatigue for the user of the mop;

Another object of this invention is to provide a mop which can be used with virtually no danger of injury;

Another object of this invention is to provide a mop which can be used with reduced danger of carpel tunnel syndrom or other repetitive motion injury;

Another object of this invention is to provide a mop which can reduce the time required to mop any given area;

Another object of this invention is to provide attachments for a customary mop handle substantially achieving the foregoing objects.

Another, and primary object of this invention is to provide a superior method of mopping using specially designed mop handles and/or mop handle attachments.

The foregoing and other objects and advantages of this invention will be understood by those skilled in the art upon reading the description of a preferred embodiment in conjunction with a review of the appended drawings.

DESCRIPTION OF A PREFERRED EMBODIMENT

Figure 1:
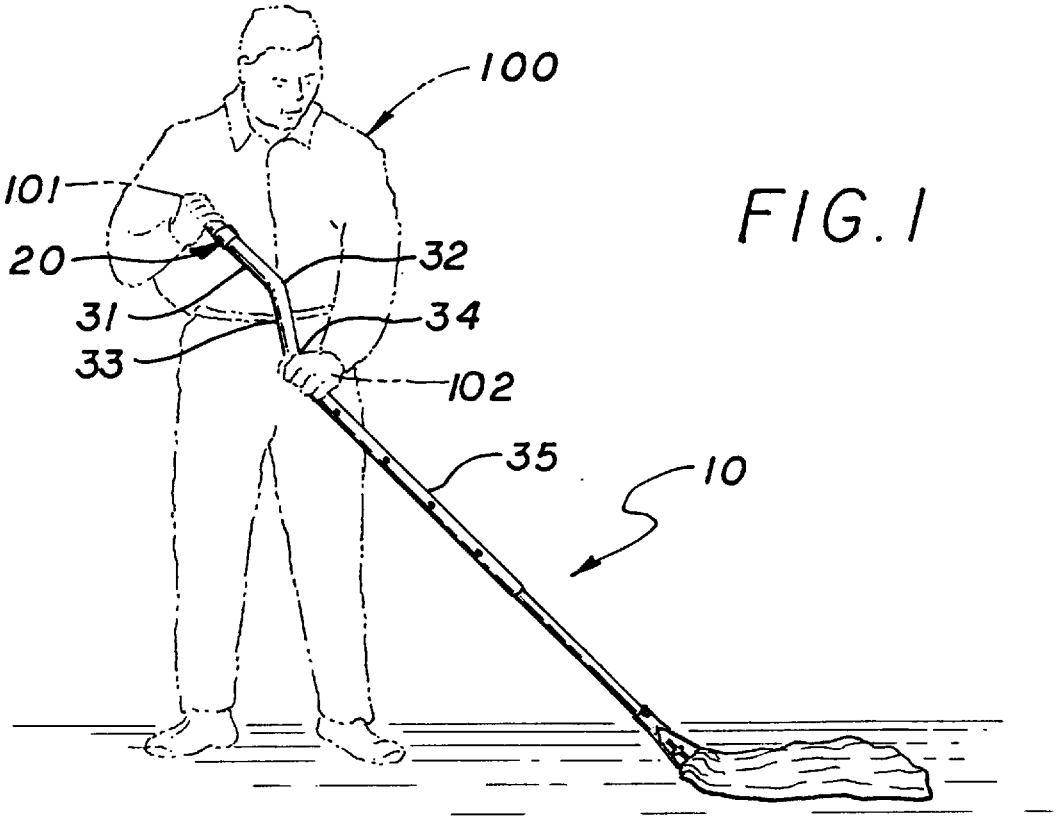
FIG. 1 is a perspective of a mop suitable to practice the method of this invention, showing a user of the mop in phantom.

The elements of the invention bearing reference numerals are:

| Reference numeral | Description |
|---|---|
| 10 | mop, generally |
| 20 | swivel, generally |
| 21 | swivel inside stem |
| 22 | swivel stem insert into handle element 31 |
| 22a | swivel stem insert shoulder |
| 23 | swivel stem enlargement |
| 23a | swivel stem enlargement shoulder |
| 24 | swivel stem shoulder cut out |
| 25 | swivel hand grip |
| 25a | cylindrical passage through hand grip |
| 26 | swivel handle shoulder enlargement |
| 26a | lower edge of shoulder enlargement |
| 27 | swivel handle cap |
| 28 | swivel stem enlarged upper interior |
| 28a | swivel hand grip interior upper shoulder |
| 29 | swivel hand grip enlarged lower cavity |
| 29a | swivel handle interior lower shoulder |
| 30 | upper mop handle segment, generally |
| 31 | second upper mop handle portion |
| 32 | first bend in upper mop handle portion |
| 33 | first upper mop handle portion |
| 34 | second bend in upper mop handle portion |
| 35 | third upper mop handle portion |
| 36 | holes in upper mop handle portion |
| 40 | lower, telescoping, mop handle portion |
| 41 | spring loaded balls in telescoping portion |
| 42 | holes in telescoping portion |
| 50 | mop and stirrup assembly, generally |
| 51 | mop and stirrup connection socket |
| 52 | mop stirrup |
| 53 | mop |
| 54 | holes in socket |
| 100 | mop user |
| 101 | right hand |
| 102 | left hand |
| 200 | Modified customary mop handle assembly |
| 201 | Customary mop handle |
| 202 | Customary mop handle extension |
| 203 | Extension adjustment holes |
| 210 | Handle attachment |
| 211 | Upper attachment sleeve |
| 212 | Angular handle member |
| 213 | Hand hold portion |
| 214 | Angular handle member |
| 215 | Lower handle sleeve |
| 216 | Lock screw |
| 220 | Swivel hand grip |
| 230 | Mop head swivel area |
| 231 | Interior indent in extension |
| 240 | Mop stirrup |
| 241 | Mop stirrup shaft |
| 242 | Enlargement on mop stirrup shaft |
| 250 | String mop |

FIG. 1 shows how a user 100 will use our new ergonomic mop handle in mopping an area. A person normally will use our new mop handle 10 with a mop by holding the swivel portion 20 with his or her right hand 101, as shown, with the left hand 102 gripping the third upper handle portion 35 beneath the offset bend 34 (depending upon individual preferences the hand positions may be reversed). In this manner the person doing the mopping can guide the mop in a wide sweep covering a greater area than is possible with a customary mop and handle, and with very little effort and none of the injury producing effects of the use of a normal mop.

In particular our unique mop handle design can more easily reach the mop under and around objects such as toilets, sinks, basins, etc. No other mop has ever been able to do this connected to any heretofore known handle.

Figure 7:
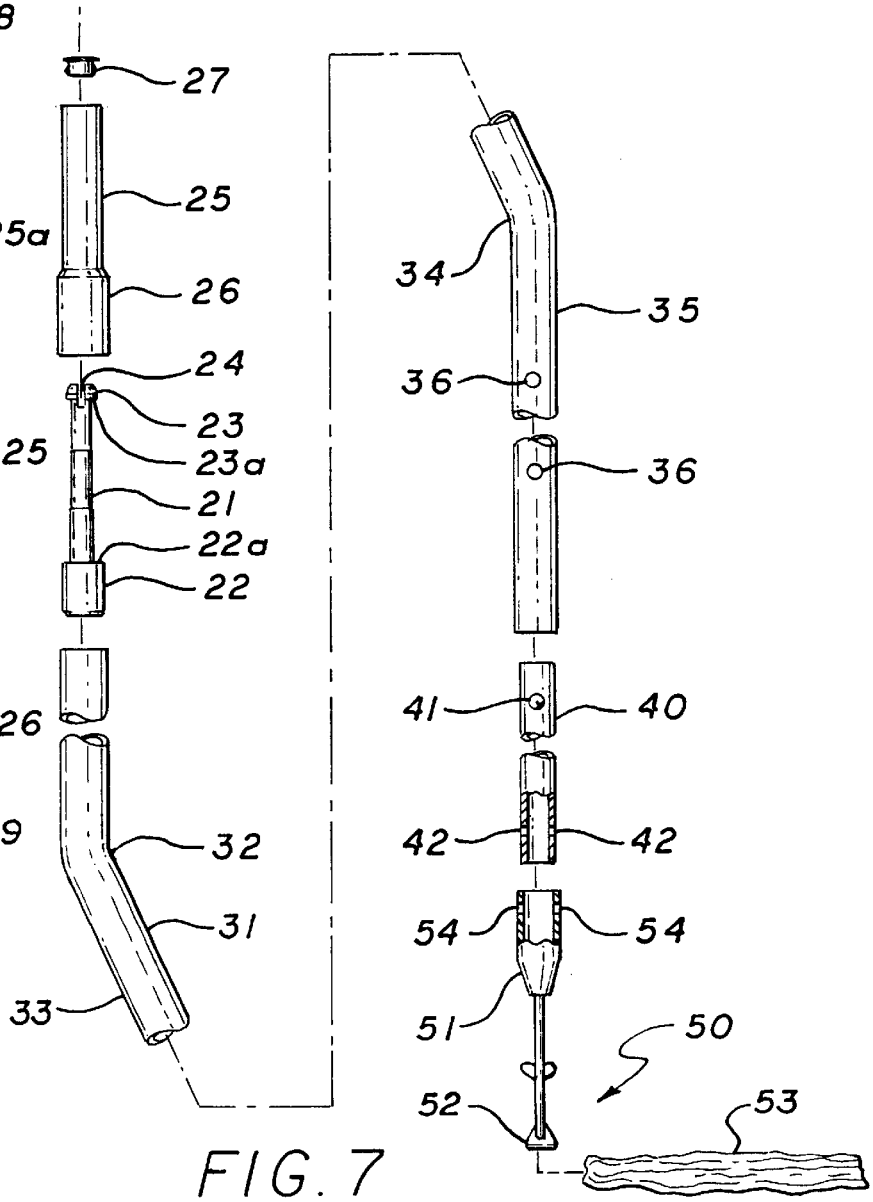
FIG. 7 is an exploded view of the mop of FIG. 1.

Exploded view FIG. 7 should be examined by those skilled in the art in order to clearly understand the many cooperative and unique features of this invention. FIG. 7, along with the other figures, make the unusual nature of this invention clear.

The swivel handle 20 at the upper end of the handle consists of an elongate cylindrical plastic rod 21 having an enlarged upper end 23 with a slot 24 to allow the enlarged portion to bend together to enter the cylindrical cavity 25*a* in the cylindrical plastic member 25. When the cylindrical portion 21 is fully inserted into the cylindrical portion 25 the enlarged portion 23 will snap back out. A cap 27 fits into and closes the top of the enlarged interior cavity 28. At this point, the shoulder 23*a* will rest rotatably upon the shoulder 28*a* of the cavity 28 within the hand grip 25 and the shoulder 29*a* of the enlarged lower cavity 29 of the hand grip will rest rotatably on the shoulder 22*a* of enlarged end 22. The end 22 will be secured by adhesive, a pin, bolt, or the like within the tubular handle portion 31.

Figure 2:
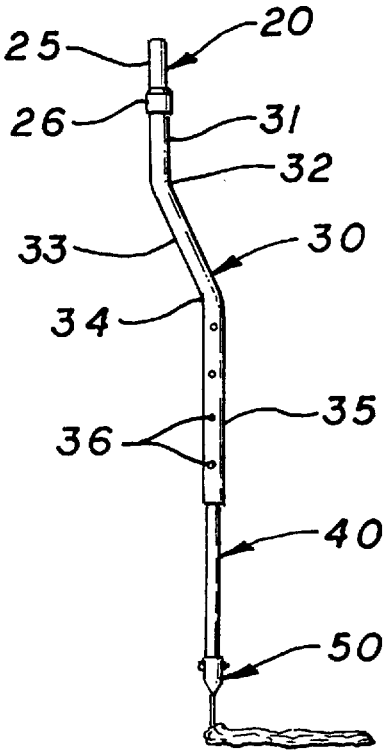
FIG. 2 is a right side elevation of the mop of FIG. 1, the left side elevation being a mirror image of FIG. 2.
Figure 3:
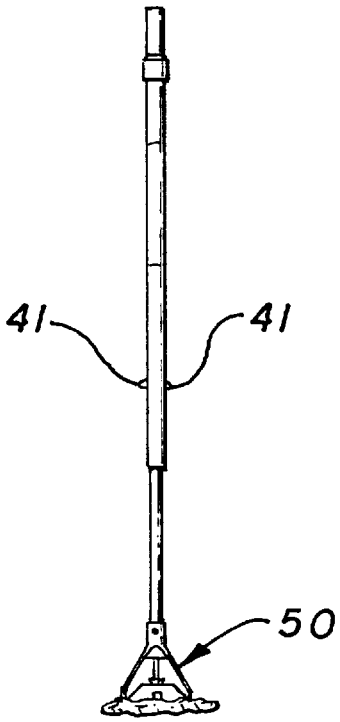
FIG. 3 is a front elevation of the mop of FIG. 1.
Figure 4:
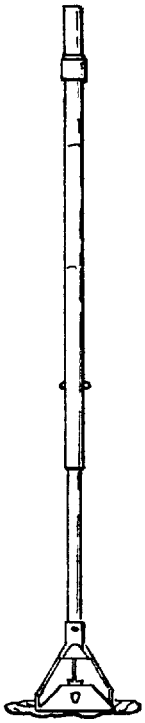
FIG. 4 is a back elevation of the mop of FIG. 1.
Figure 5:
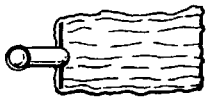
FIG. 5 is a top elevation of the mop of FIG. 1.
Figure 6:
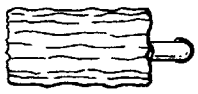
FIG. 6 is a bottom elevation of the mop of FIG. 1.
Figure 8:
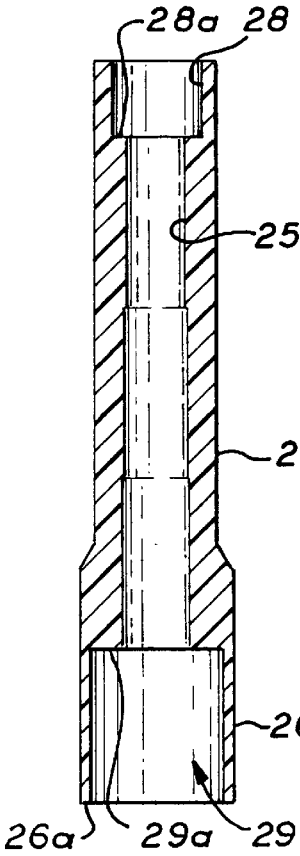
FIG. 8 is an exploded view of a preferred swivel handle for a mop of this invention.

The handle 30 is formed of aluminum tubing or the like. The handle is particularly well shown in FIG. 2. The swivel 20 is shown in place in the tubing portion 31 above a second offset bend 32. Bend 32 and a first bend 34 define a portion 33 of the handle. Each bend will preferably be in the range of 20 to 25 degrees from the axis of tubing portions 31 and 35 which will be parallel to each other. The individual portions of the handle should be in the approximate proportions to those proportions shown in the drawings. In actuality, the over handle length will be about 52 inches long, with adjustment of length possible due to the telescoping lower portion 40. Adjustment of length is provided by depressing spring loaded balls 41 and moving to a different set of holes 36 where the spring loaded balls will snap in place to lock in the adjusted position (note that only one ball and one set of holes is shown, but there is another 180 degrees from those shown, thus not visible in the drawings).

Holes 42 are provided on the sides to allow for fastening of the mop assembly 50 consisting of stirrup 52 and mop 53 by insertion of a bolt through holes 54 which are in the sides of the mop stirrup socket 51 and holes 42 which are in the telescoping portion 40. Other means of fastening the mop could be used if desired.

Figures 9, 9A:
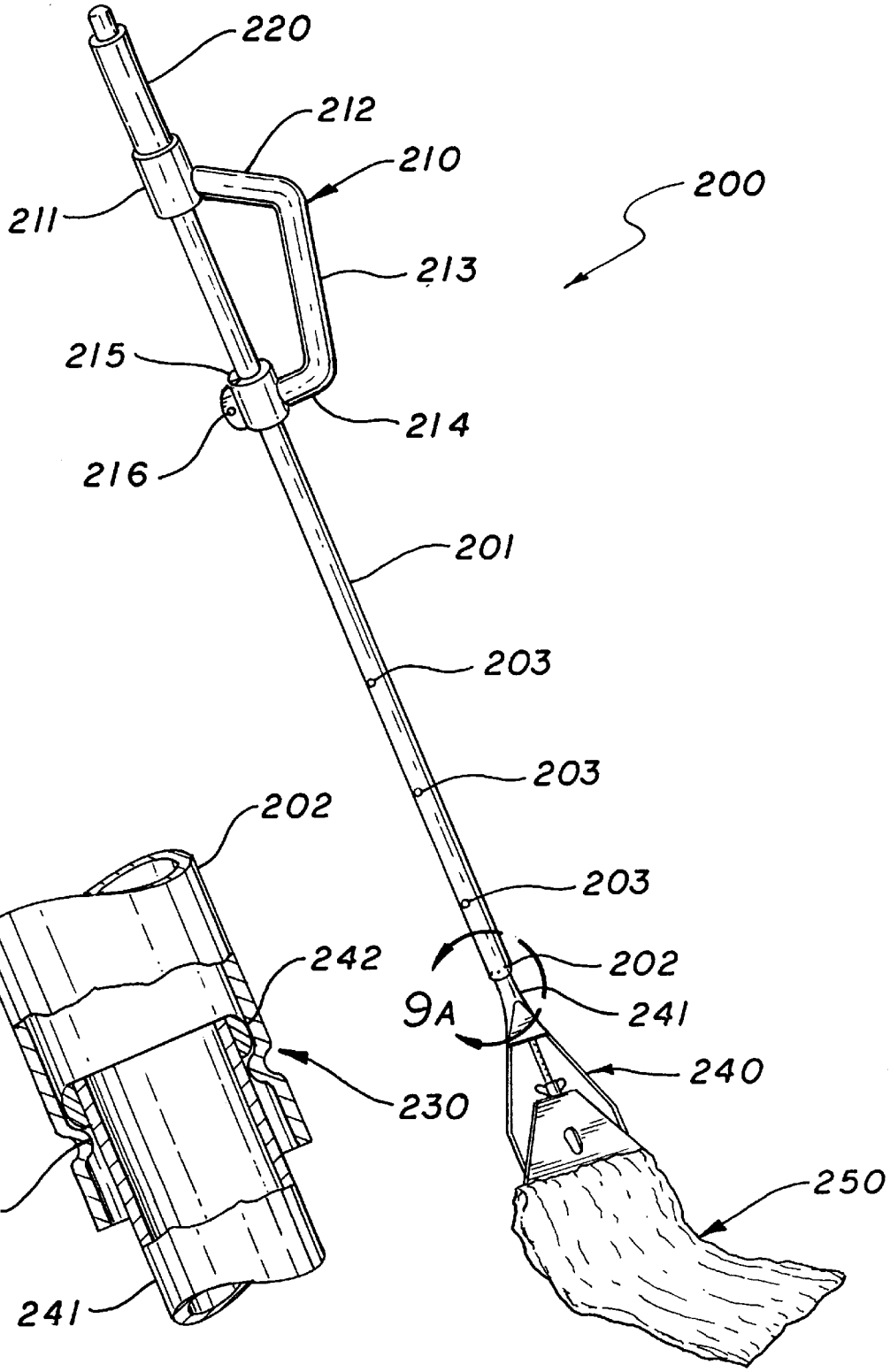
FIG. 9 is a schematic perspective of an alternate embodiment of a mop suitable to practice the method of this invention.
FIG. 9A is an enlarged, partially sectioned, perspective of the area 9A of FIG. 9.

FIG. 9 illustrates a modified customary mop assembly 200 with special mop handle attachment 210, which can be attached to any standard mop handle in order to approximate the advantages of our mop handle shown in the other illustrations and our method of mopping. This attachment 210 has two sleeves 211 and 215 which slip over a tubular mop handle 201 which carries a string mop or the like 250 on attached mop stirrup 240.

The attachment 210 has a straight tubular hand hold portion 213 at an angle to approximate the second (hand hold) upper portion 33 of our bent handle illustrated and described above and is connected to sleeves 211 and 215 by angular extensions 212 and 214. The attachment 210 is locked onto the mop handle 201 by lock screw or the like 216.

The stirrup 240 is especially connected to mop handle 201 by a unique swivel arrangement at 230. The mop stirrup has a shaft 241 with an upper circumferential enlargement 242. The mop handle is equipped with an elongated extension 202 which can be adjusted in manner known to those skilled in the art by use of a bolt or the like (not shown) into one of the series of connection holes 203. After the mop stirrup shaft is inserted in the extension, a series of indentations 231 may be made by a punch or the like, or an interior collar may be formed at that position so that the string mop can swivel at the end of an arc of the mop, thus staying in proper position when mopping in our special method described herein.

In the embodiment of FIG. 9 we also provide an upper swivel hand grip 220 which can be a simple sleeve resting on sleeve 211. The sleeve, or rotating grip can be connected to the sleeve 211 if desired.

Our method for mopping incorporates the use of our offset mop handle or attachment in which the hands of the person mopping are offset with the upper hand holding a swivel grip attached to the extreme end of the mop handle. The lower hand grips an angularly offset portion of the mop handle or special attachment to the mop handle well beneath the upper hand. The special swiveling mop stirrup described above may also be employed to further enhance the method. With these features, the method of mopping includes holding the upper handle swivel grip in a nearly stationary position while guiding the mop in wide, low arcs so that the mop itself covers much larger areas than is possible under previous mopping habits. Additionally, the mop used this way can easily be guided under and around objects such as benches, toilets, wash basins, and the like. Using the swivel mop stirrup is a further enhancement in that the swivel allows the mop to go to its farthest possible reach, swiveling to extend the mop to the maximum use.

Certain materials or elements have been named such as plastic, aluminum, bolts, spring loaded balls, etc. While the definition of such materials or elements may, in some instances be inventive in themselves, it is not intended that such terms be completely definitive nor limiting. The substitution of other suitable materials or elements is intended to fall within the scope of this invention as set forth in the claims.

While the embodiments of this invention shown and described are fully capable of achieving the objects and advantages desired, such embodiments have been shown for purposes of illustration only and not for purposes of limitation.

We claim:

1. A method of mopping comprising: forming an offset mop handle having a first end and a second end and having a first angular bend and a second angular bend intermediate said first end and said second end such that the portion of said handle carrying the first end and the portion of the handle carrying the second end are parallel to each other but in different planes; fastening a mop to the first end; fastening a swivel hand grip the second end; a mop user gripping the said swivel grip with a first hand; the mop user gripping the portion of the handle intermediate the first end and the first angular bend with a second hand; the mop user moving the mop in an arc with his second hand; and the mop user guiding the mop handle by allowing the swivel to turn while maintaining the first hand in a relatively fixed position.

2. The method of claim 1 wherein the mop is attached to the first end of the mop handle by a swivel connection and the mop is caused to swivel 180 degrees at each end of each arc.

* * * * *